US011320771B2

(12) United States Patent
Saito

(10) Patent No.: US 11,320,771 B2
(45) Date of Patent: May 3, 2022

(54) IMAGE FORMING APPARATUS PROVIDED WITH A DEVELOPING DEVICE AND A CLEANING DEVICE FOR AN IMAGE CARRYING MEMBER

(71) Applicant: KYOCERA Document Solutions Inc., Osaka (JP)

(72) Inventor: Yosuke Saito, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/369,227

(22) Filed: Jul. 7, 2021

(65) Prior Publication Data

US 2022/0011702 A1 Jan. 13, 2022

(30) Foreign Application Priority Data

Jul. 13, 2020 (JP) ..... JP2020-119975

(51) Int. Cl.
*G03G 21/00* (2006.01)
*G03G 15/00* (2006.01)
*G03G 21/20* (2006.01)

(52) U.S. Cl.
CPC ..... *G03G 15/50* (2013.01); *G03G 21/0011* (2013.01); *G03G 21/203* (2013.01)

(58) Field of Classification Search
CPC ..... G03G 15/50; G03G 21/0005; G03G 21/0011; G03G 21/0094; G03G 21/20
USPC ..... 399/13, 44, 346, 347, 350
See application file for complete search history.

(56) References Cited

U.S. PATENT DOCUMENTS 8,254,820 B2 * 8/2012 Hanano ..... G03G 21/007 399/349
8,320,785 B2 * 11/2012 Ishida ..... G03G 15/0849 399/347
9,261,820 B2 * 2/2016 Wakayama ..... G03G 21/0011
9,541,888 B2 * 1/2017 Hanano ..... G03G 21/0011

FOREIGN PATENT DOCUMENTS

JP 2011-13349 A 1/2011

* cited by examiner

*Primary Examiner* — William J Royer
(74) *Attorney, Agent, or Firm* — Stein IP, LLC

(57) ABSTRACT

An image forming apparatus includes a photosensitive drum, a charging device, an exposing device, a developing device, and a cleaning device. The cleaning device includes a toner keeping member, which has toner keeping portions disposed respectively at opposite end sides of a polishing roller along its axial direction with a gap from an outer circumferential surface of the polishing roller to keep between themselves and the polishing roller toner removed off an outer circumferential surface of the photosensitive drum. The toner keeping portions extend along the axial direction of the polishing roller, and of each toner keeping portion, one end part along the axial direction is located outward of an end part of a guaranteed development region but inward of an end part of a developing roller and another end part is located outward of an end part of the polishing roller.

9 Claims, 6 Drawing Sheets

IMAGE FORMING APPARATUS PROVIDED WITH A DEVELOPING DEVICE AND A CLEANING DEVICE FOR AN IMAGE CARRYING MEMBER

INCORPORATION BY REFERENCE

This application is based on and claims the benefit of Japanese Patent Application No. 2020-119975 filed on Jul. 13, 2020, the contents of which are hereby incorporated by reference.

BACKGROUND

The present disclosure relates to image forming apparatuses.

It is known that in image forming apparatuses relying on electrophotography, such as copiers and printers, the outer circumferential surface of an image carrying member such as a photosensitive drum is prone to be deposited with electric discharge products produced through electric discharge by a charging device. Such electric discharge products, when they absorb moisture, reduce the electrical resistance of the outer circumferential surface of the photosensitive drum and disturb an electrostatic latent image, a trouble called image deletion.

As a remedy, according to a known method, a tiny amount of an additive (abrasive) is mixed in toner, and the toner settled on the outer circumferential surface of a photosensitive drum is removed by use of a polishing roller combined with a cleaning blade. Here, the toner (abrasive) is attached to the outer circumferential surface of the photosensitive drum so that, with the toner, the electric discharge products deposited on the outer circumferential surface of the photosensitive drum are polished off, thereby achieving cleaning.

For example, a known image forming apparatus includes a cleaning roller (polishing roller), a cleaning blade, and a plate roll (toner keeping member). The cleaning roller rotates, while in contact with a photosensitive drum, about a rotation axis parallel to the rotation axis of the photosensitive drum, and removes deposits on the outer circumferential surface of the photosensitive drum by using toner as abrasive. The cleaning blade is disposed downstream, in the drum rotation direction, of a contact part between the photosensitive drum and the cleaning roller, and makes contact with the outer circumferential surface of the photosensitive drum to scrape toner off. The plate roll is disposed near the cleaning roller, and forms a storage space for the toner scraped off the outer circumferential surface of the photosensitive drum by the cleaning blade. The plate roll makes it easier for the toner in the storage space to attach to the outer circumferential surface of the cleaning roller. This achieves effective cleaning operation on the outer circumferential surface of the photosensitive drum.

SUMMARY

According to one aspect of the present disclosure, an image forming apparatus includes an image carrying member, a charging device, an exposing device, a developing device, and a cleaning device. The image carrying member has a photosensitive layer on its outer circumferential surface. The charging device electrostatically charges the outer circumferential surface of the image carrying member. The exposing device exposes to light the outer circumferential surface of the image carrying member electrostatically charged by the charging device to form an electrostatic latent image on the outer circumferential surface of the image carrying member. The developing device includes a developing roller, which extends parallel to an axial direction of the image carrying member and is disposed close to the image carrying member and which attaches toner to the electrostatic latent image to form a toner image. The cleaning device includes a cleaning blade, which extends along the axial direction of the image carrying member and which makes contact with the outer circumferential surface of the image carrying member to remove toner on the outer circumferential surface of the image carrying member, and a polishing roller, which extends parallel to the axial direction of the image carrying member and which rotates while in contact with the outer circumferential surface of the image carrying member to polish the outer circumferential surface of the image carrying member. The developing roller has a guaranteed development region that extends over a predetermined length from the middle toward opposite end sides along an axial direction, Opposite end parts of the polishing roller along the axial direction are located outward of opposite end parts of the developing roller. The cleaning device has a toner keeping member, which has toner keeping portions that are disposed at opposite end sides of the polishing roller along the axial direction with a gap left from an outer circumferential surface of the polishing roller and that keep between themselves and the polishing roller the toner removed off the outer circumferential surface of the image carrying member. The toner keeping portions extend along the axial direction of the polishing roller, and of each of the toner keeping portions, one end part along the axial direction is located outward of an end part of the guaranteed development region but inward of an end part of the developing roller and another end part is located outward of the end part of the polishing roller.

DETAILED DESCRIPTION

An embodiment of the present disclosure will be described below with reference to the accompanying drawings. The following description is in no way meant to limit the scope of the present disclosure.

Figure 1:
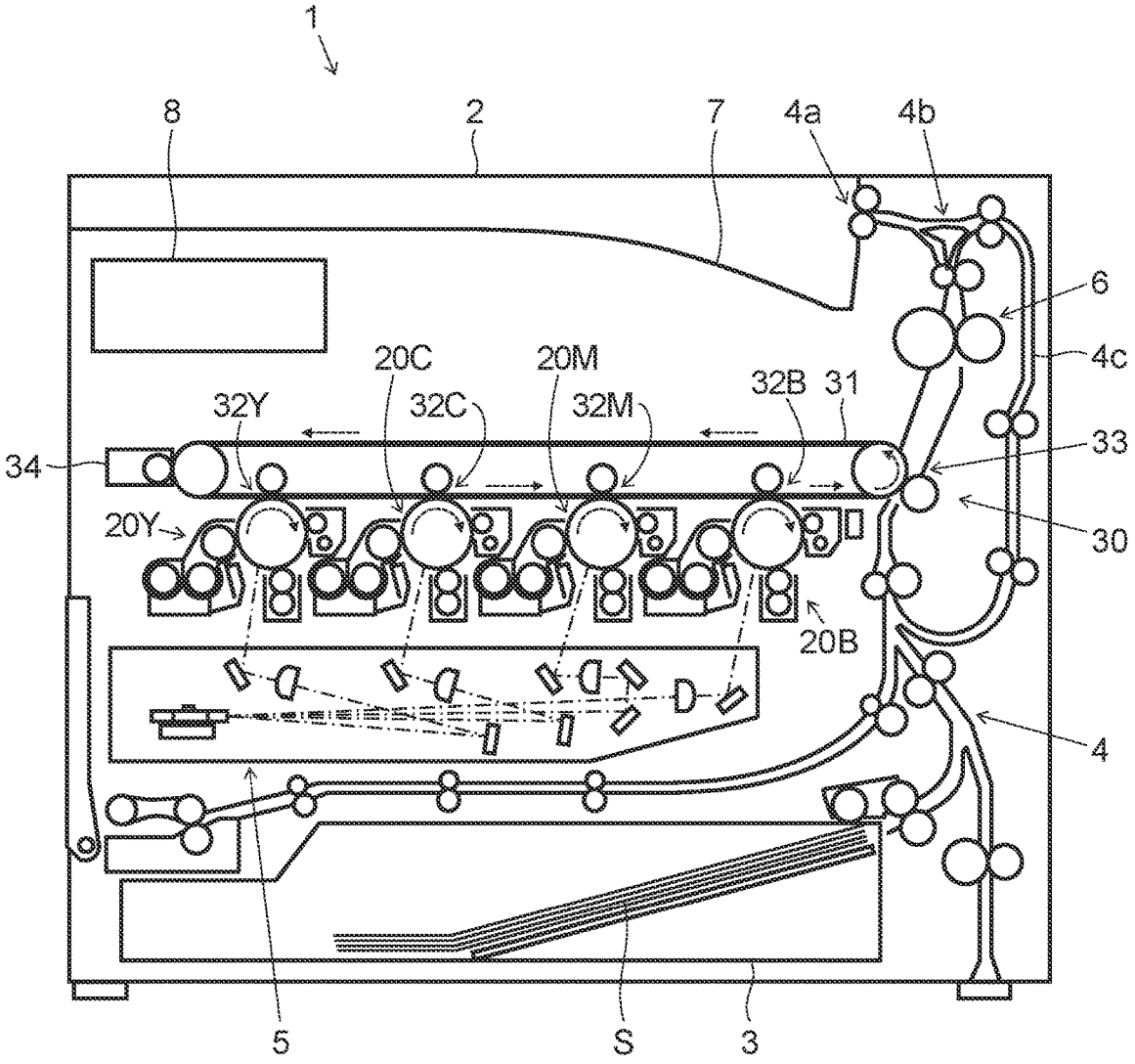
FIG. 1 is a sectional view showing an outline of a construction of an image forming apparatus according to an embodiment.
Figure 2:
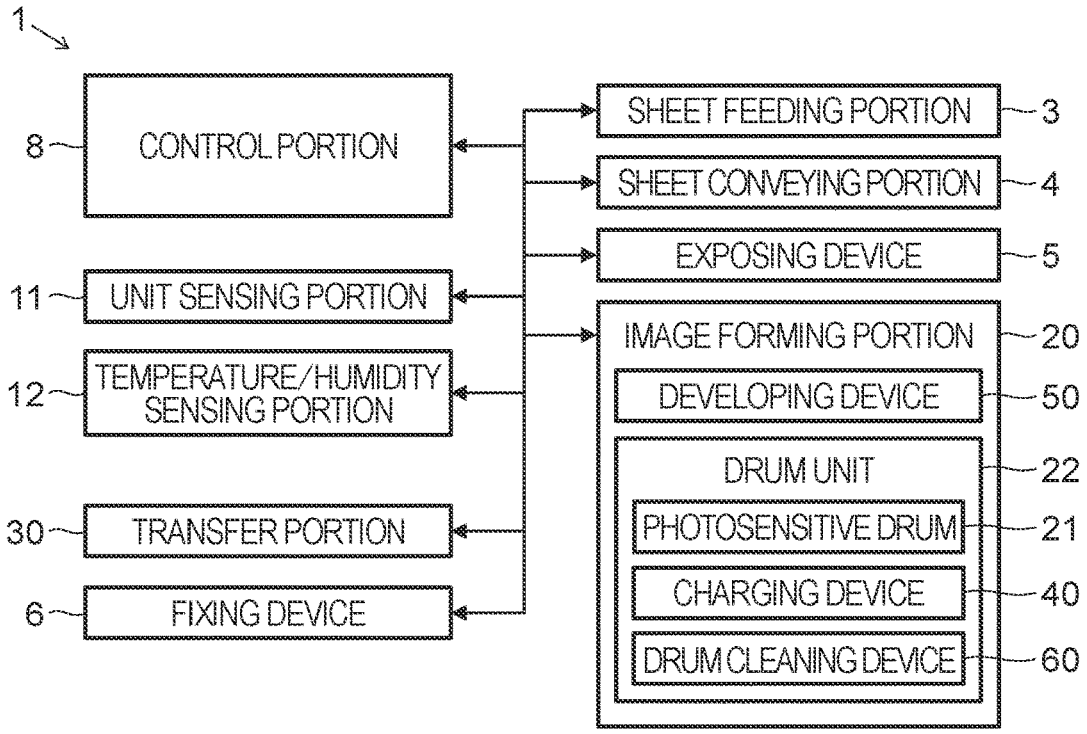
FIG. 2 is a block diagram showing an outline of a configuration of the image forming apparatus in FIG. 1.
Figure 3:
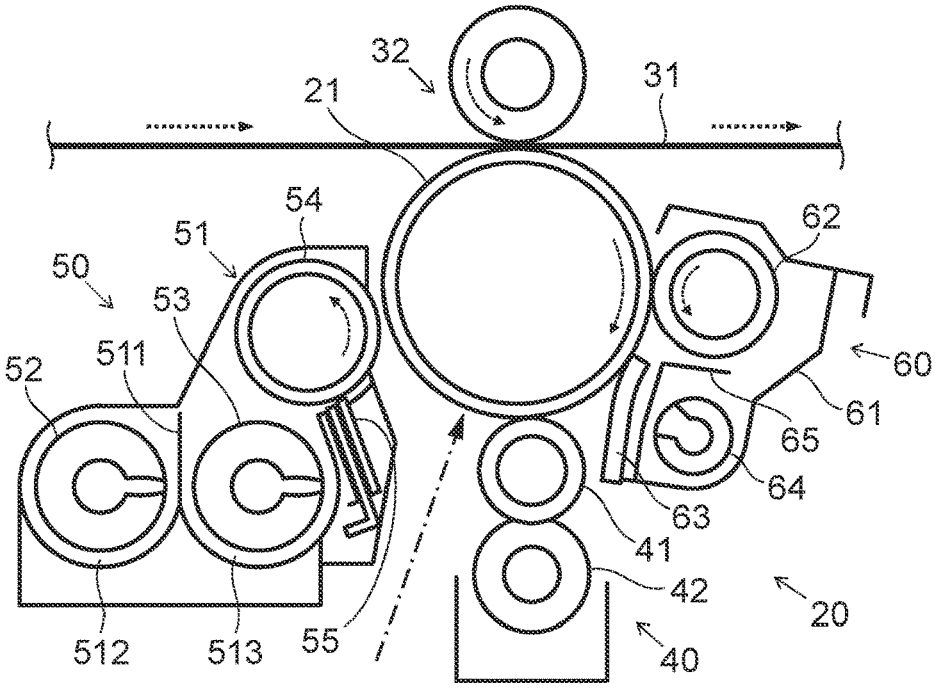
FIG. 3 is a sectional view around an image forming portion in the image forming apparatus in FIG. 1.

FIG. 1 is a sectional view showing an outline of a construction of an image forming apparatus 1 according to an embodiment. FIG. 2 is a block diagram showing an outline of a configuration of the image forming apparatus 1 in FIG. 1, FIG. 3 is a sectional view around an image forming portion 20 in the image forming apparatus 1 in FIG. 1. One example of the image forming apparatus 1 according to the embodiment is a tandem-type color printer in which a toner image is transferred to a sheet S by use of an intermediate transfer belt 31. The image forming apparatus 1 can be what is called a multifunction peripheral furnished with the functions of printing, scanning (image reading), facsimile transmission, and the like.

As shown in FIGS. 1, 2, and 3, the image forming apparatus 1 includes, housed inside a main body 2, a sheet feeding portion 3, a sheet conveying portion 4, an exposing device 5, the image forming portion 20, a transfer portion 30, a fixing device 6, a sheet discharge portion 7, and a control portion 8.

The sheet feeding portion 3 stores a plurality of sheets S and, during printing, feeds out the sheets S one by one separately. The sheet conveying portion 4 conveys a sheet S fed out from the sheet feeding portion 3 to a secondary transfer portion 33 and then to the fixing device 6. The sheet conveying portion 4 also discharges a sheet S having undergone fixing through a sheet discharge port 4*a* to the sheet discharge portion 7. When duplex printing is performed, the sheet conveying portion 4 directs, with a branch portion 4*b*, a sheet S having undergone fixing on its first side to a reversal conveying portion 4*c*, thereby to convey the sheet S once again to the secondary transfer portion 33 and then to the fixing device 6. The exposing device 5 irradiates the image forming portion 20 with laser light controlled based on image data.

The image forming portion 20 is disposed under the intermediate transfer belt 31. The image forming portion 20 includes an image forming portion 20Y for yellow, an image forming portion 20C for cyan, an image forming portion 20M for magenta, and an image forming portion 20B for black. These four image forming portions 20Y, 20C, 20M, and 20B have basically the same construction. Accordingly, in the following description, unless distinction is necessary the suffixes "Y", "C", "M", and "B" distinguishing different colors will be omitted.

The image forming portion 20 includes a photosensitive drum (image carrying member) 21 supported so as to be rotatable in a predetermined direction (clockwise in FIGS. 1 and 3). The image forming portion 20 further includes, around the photosensitive drum 21 along its rotation direction, a charging device 40, a developing device 50, and a drum cleaning device (cleaning device) 60. Between the developing device 50 and the drum cleaning device 60, primary transfer portions 32 are disposed.

The photosensitive drum 21 has a photosensitive layer on its outer circumferential surface. The charging device 40 electrostatically charges the outer circumferential surface of the photosensitive drum 21 up to a predetermined potential. The exposing device 5 exposes to light the outer circumferential surface of the photosensitive drum 21 electrostatically charged by the charging device 40, and thereby forms an electrostatic latent image of a document image on the outer circumferential surface of the photosensitive drum 21. The developing device 50 develops the electrostatic latent image by attaching toner to it, and thereby forms a toner image. The four image forming portions 20Y, 20C, 20M, and 20B form toner images of different colors respectively.

The transfer portion 30 includes the intermediate transfer belt 31, primary transfer portions 32Y, 32C, 32M, and 32B, the secondary transfer portion 33, and a belt cleaning portion 34. The intermediate transfer belt 31 is disposed over the four image forming portions 20Y 20C, 20M, and 20B. The intermediate transfer belt 31 is an intermediate transfer member that is supported so as to be rotatable in a predetermined direction (counter-clockwise in FIG. 1) and to which the toner images formed in the four image forming portions 20Y, 20C, 20M, and 20B respectively are primarily transferred sequentially so as to be overlaid on each other. The four image forming portions 20Y, 20C. 20M, and 20B are disposed side by side in a row, that is, in what is called a tandem formation, from upstream to downstream in the rotation direction of the intermediate transfer belt 31.

The primary transfer portions 32Y, 32C, 32M, and 32B are disposed over the image forming portions 20Y, 20C, 20M, and 20B for the different colors, across the intermediate transfer belt 31. The secondary transfer portion 33 is disposed, in relation to the sheet conveying portion 4, upstream of the fixing device 6 in the sheet conveyance direction and, in relation to the transfer portion 30, downstream of the image forming portions 20Y, 20C, 20M, and 20B for the different colors in the rotation direction of the intermediate transfer belt 31. The belt cleaning portion 34 is disposed upstream of the image forming portions 20Y, 20C, 20M, and 20B for the different colors in the rotation direction of the intermediate transfer belt 31.

Toner images are primarily transferred to the outer circumferential surface of the intermediate transfer belt 31 in the primary transfer portions 32Y, 32C, 32M, and 32B for the different colors. As the intermediate transfer belt 31 rotates, the toner images formed in the four image forming portions 20Y, 20C, 20M, and 20B are transferred sequentially to the intermediate transfer belt 31 with predetermined timing so as to be overlaid on each other. Thus on the outer circumferential surface of the intermediate transfer belt 31 is formed a color toner image having toner images of four colors, namely yellow, cyan, magenta, and black, overlaid on each other. The drum cleaning device 60 cleans the outer circumferential surface of the photosensitive drum 21 by removing the residual toner and the like left behind there after primary transfer.

The color toner image on the outer circumferential surface of the intermediate transfer belt 31 is, in a secondary transfer nip portion formed in the secondary transfer portion 33, transferred to a sheet S conveyed there in a coordinated manner by the sheet conveying portion 4. The belt cleaning portion 34 cleans the outer circumferential surface of the intermediate transfer belt 31 by removing the residual toner and the like left behind there after secondary transfer.

The fixing device 6 heats and presses the sheet S having the toner image transferred to it, and thereby fixes the toner image to the sheet S.

The control portion 8 includes a CPU, an image processing portion, a storage portion, and other electronic circuits and electronic components (of which none are illustrated). The CPU controls the operation of the individual components provided in the image forming apparatus 1 based on control programs and data stored in the storage portion, and thereby performs processes related to the functions of the image forming apparatus 1. The sheet feeding portion 3, the sheet conveying portion 4, the exposing device 5, the image forming portion 20, the transfer portion 30, and the fixing device 6 each individually receive instructions from the control portion 8, and operate in a coordinated manner to perform printing on a sheet S. The storage portion can be configured as, for example, a combination of a nonvolatile memory device, such as a program ROM (read-only memory) and a data rom, and a volatile memory device, such as a RAM (random-access memory).

Figure 4:
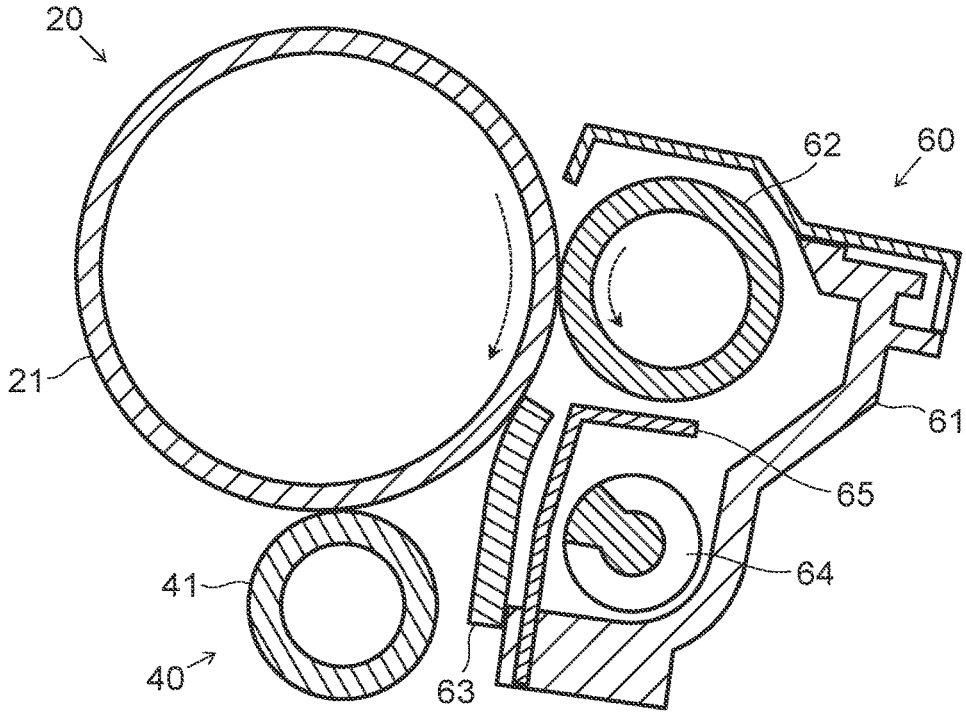
FIG. 4 is a sectional view around a drum cleaning device in the image forming portion in FIG. 3.

Next the configuration of the image forming portion 20 will be described with reference to FIGS. 3 and 4. FIG. 4 is a sectional view around the drum cleaning device 60 in the image forming portion 20 in FIG. 3. Since the image forming portions 20 for the different colors have basically the same construction, unless distinction is necessary the suffixes distinguishing different colors will be omitted from the reference signs of their components, and no overlapping description will be repeated.

As mentioned previously, the image forming portion 20 includes the photosensitive drum 21, the charging device 40, the developing device 50, and the drum cleaning device 60, all shown FIG. 3. Of these components, the photosensitive drum 21, the charging device 40, and the drum cleaning device 60 are integrated into a unit, namely a drum unit (unit) 22. Thus the drum unit 22 includes the photosensitive drum 21 and the drum cleaning device 60. The drum unit 22 is removably mounted in the main body 2 of the image forming apparatus 1.

The photosensitive drum 21 has the shape of a cylinder that is rotatably supported with its center axis horizontal, and is rotated about the center axis at a constant speed by a driving portion (not illustrated). The photosensitive drum 21 is a plain drum formed of metal such as aluminum of which the outer circumferential surface is coated with a photosensitive layer formed of an inorganic photosensitive substance such as amorphous silicon. On the outer circumferential surface of the photosensitive drum 21, an electrostatic latent image is formed.

The charging device 40 includes, for example, a charging roller 41 and a charging cleaning roller 42.

The charging roller 41 extends parallel to the axial direction of the photosensitive drum 21, and is rotatably supported with its center axis horizontal. The charging roller 41 stays in contact with the outer circumferential surface of the photosensitive drum 21, and thus rotates as the photosensitive drum 21 rotates. The charging roller 41 has, for example, an electrically conductive layer formed of cross-linked rubber blended with an ion-conductive material on the outer circumferential surface of a metal base. When a predetermined charging voltage is applied to the charging roller 41, which stays in contact with the outer circumferential surface of the photosensitive drum 21 and rotates by following it, the outer circumferential surface of the photosensitive drum 21 is electrostatically charged uniformly. The charging cleaning roller 42 stays in contact with the outer circumferential surface of the charging roller 41, and cleans the outer circumferential surface of the charging roller 41.

The developing device 50 includes a developer container 51, a first stirring-conveying member 52, a second stirring-conveying member 53, a developing roller 54, and a restricting member 55.

The developer container 51 has an elongate shape extending along the axial direction of the photosensitive drum 21 (the direction toward the far side of the plane of FIG. 3), and is disposed with its longitudinal direction horizontal. The developer container 51 stores, for example, two-component developer containing toner and magnetic carrier as the developer that is supplied from the developing device 50 to the outer circumferential surface of the photosensitive drum 21. The developer container 51 includes a partition 511, a first conveying chamber 512, and a second conveying chamber 513.

The partition 511 is provided in a lower part inside the developer container 51. The partition 511 is provided in a substantially middle part, in a direction (in FIG. 3, the left-right direction) crossing the axial direction, in the lower part of the developer container 51, and extends in the axial direction and in the up-down direction. The partition 511 divides the interior of the developer container 51 in a direction (in FIG. 3, the left-right direction) crossing the axial direction. The partition 511 has developer communication portions (not illustrated) disposed in opposite end parts of it in the axial direction.

The first and second conveying chambers 512 and 513 are provided inside the developer container 51. The first and second conveying chambers 512 and 513 are formed by the interior of the developer container 51 being divided by the partition 511, and are located side by side. The second conveying chamber 513 is disposed inside the developer container 51, under the region where the developing roller 54 is disposed, adjacent to it. The first conveying chamber 512 is disposed inside the developer container 51, in a region farther from the developing roller 54 than is the second conveying chamber 513. The first conveying chamber 512 is supplied with developer through a developer supply pipe (not illustrated).

The first stirring-conveying member 52 is disposed inside the first conveying chamber 512. The second stirring-conveying member 53 is disposed inside the second conveying chamber 513. The second stirring-conveying member 53 is disposed close to, and extends parallel to, the developing roller 54. The first and second stirring-conveying members 52 and 53 are supported on the developer container 51 so as to be rotatable about axes extending parallel to the photosensitive drum 21. The first and second stirring-conveying members 52 and 53 rotate about their respective axes, and convey, while stirring, developer in opposite directions along the axis of their rotation.

As the first and second stirring-conveying members 52 and 53 rotate, developer circulates between the first and second conveying chambers 512 and 513 by passing through the developer communication portions provided in opposite end parts of the partition 511 along the axial direction. In the first and second conveying chambers 512 and 513, the toner (positively charged toner) supplied from outside is mixed with magnetic carrier and is stirred to be electrostatically charged.

The developing roller 54 is disposed inside the developer container 51, over the second stirring-conveying member 53. The developing roller 54 is supported on the developer container 51 so as to be rotatable about an axis extending parallel to the axis of the photosensitive drum 21. The developing roller 54 includes, for example, a cylindrical developing sleeve that rotates counter-clockwise in FIG. 3 and developing roller magnetic poles that are fixed inside the developing sleeve (none of those are illustrated).

Part of the outer circumferential surface of the developing roller 54 is exposed out of the developer container 51 to face the photosensitive drum 21 close to it. The developing roller 54 carries on its outer circumferential surface the toner to be supplied to the outer circumferential surface of the photosensitive drum 21 in a region where the developing roller 54 faces the photosensitive drum 21. The developing roller 54 attaches the toner in the second conveying chamber 513 to an electrostatic latent image on the outer circumferential surface of the photosensitive drum 21, and thereby forms a toner image.

The restricting member 55 is disposed upstream, in the rotation direction of the developing roller 54, of the region where the developing roller 54 faces the photosensitive drum 21. The restricting member 55 is disposed so as to face the developing roller 54 close to it with a predetermined gap left between the tip end of the restricting member 55 and the outer circumferential surface of the developing roller 54. The restricting member 55 extends over the entire region of the developing roller 54 in its axial direction (in FIG. 3, the direction toward the far side of the plane of FIG. 3). The restricting member 55 restricts the layer thickness of the developer (toner) carried on the outer circumferential surface of the developing roller 54.

The toner in the developer container 51 is stirred, circulated, and electrostatically charged by the first and second stirring-conveying members 52 and 53, and is passed to the outer circumferential surface of the developing roller 54 by the second stirring-conveying member 53. On the outer circumferential surface of the developing roller 54, a magnetic brush (not illustrated) is formed by toner and magnetic carrier. The magnetic brush has its layer thickness restricted by the restricting member 55, and is then, as the developing roller 54 rotates, conveyed to the region where the developing roller 54 faces the photosensitive drum 21. When a predetermined developing voltage is applied to the developing roller 54, a potential difference there from the potential on the outer circumferential surface of the photosensitive drum 21 causes the toner carried on the outer circumferential surface of the developing roller 54 to fly to the outer circumferential surface of the photosensitive drum 21, and thereby the electrostatic latent image on the outer circumferential surface of the photosensitive drum 21 is developed.

As shown in FIGS. 3 and 4, the drum cleaning device 60 includes a collection container 61, a polishing roller 62, a cleaning blade 63, a collecting spiral 64, and a toner keeping member 65.

The collection container 61 has an elongate shape extending along the axial direction (the direction toward the far side of the plane of FIG. 4) of the photosensitive drum 21, and is disposed with its longitudinal direction horizontal. The collection container 61 stores the residue such as toner that has been removed off the outer circumferential surface of the photosensitive drum 21 by the polishing roller 62 and the cleaning blade 63.

The polishing roller 62 is supported on the collection container 61 so as to be rotatable about an axis extending parallel to the axis of the photosensitive drum 21. Part of the outer circumferential surface of the polishing roller 62 is exposed out of the collection container 61 to face the photosensitive drum 21, and stays in contact with the outer circumferential surface of the photosensitive drum 21 under a predetermined pressure. The polishing roller 62, while in contact with the outer circumferential surface of the photosensitive drum 21, rotates in such a direction that the region where the polishing roller 62 makes contact with the photosensitive drum 21 moves in the same direction as the photosensitive drum 21. The polishing roller 62 may be rotated at a speed different from the speed at which the photosensitive drum 21 is rotated. The roller member of the polishing roller 62 is formed of a layer of a foam material such as EPDM (ethylene-propylene-diene rubber). The polishing roller 62 polishes the outer circumferential surface of the photosensitive drum 21.

The toner that is supplied from the developing device 50 to the outer circumferential surface of the photosensitive drum 21 is blended with abrasive as an additive. The toner is used not only to form a toner image by being attached to the electrostatic latent image on the outer circumferential surface of the photosensitive drum 21 but also, in the form of the residual toner that is not transferred to the intermediate transfer belt 31 during primary transfer, to polish the outer circumferential surface of the photosensitive drum 21.

The cleaning blade 63 is disposed downstream of the polishing roller 62 in the drum rotation direction. The cleaning blade 63 has the shape of a plate extending along the axis of the photosensitive drum 21, and is formed of, for example, an elastic material such as polyurethane rubber. So that the cleaning blade 63 forms a predetermined angle to the direction tangential to the photosensitive drum 21 at the point of their contact, the cleaning blade 63 is disposed downstream of the point of contact in the drum rotation direction. The cleaning blade 63 is in contact with the outer circumferential surface of the photosensitive drum 21 under a predetermined pressure. The cleaning blade 63 removes the residue such as toner that is left behind on the outer circumferential surface of the photosensitive drum 21 after primary transfer.

The collecting spiral 64 is disposed under the polishing roller 62, in a region away from the photosensitive drum 21 across the cleaning blade 63. The collecting spiral 64 is supported on the collection container 61 so as to be rotatable about an axis extending parallel to the axis of the photosensitive drum 21. The collecting spiral 64 conveys the residue such as toner that has been removed off the outer circumferential surface of the photosensitive drum 21 to a collected material disposal container (not illustrated) provided outside the drum cleaning device 60.

The toner keeping member 65 is disposed under the polishing roller 62, between the cleaning blade 63 and the collecting spiral 64. The toner keeping member 65 is a plate-form member extending along the axial direction of the polishing roller 62, and is formed by bending a metal plate.

Figure 5:
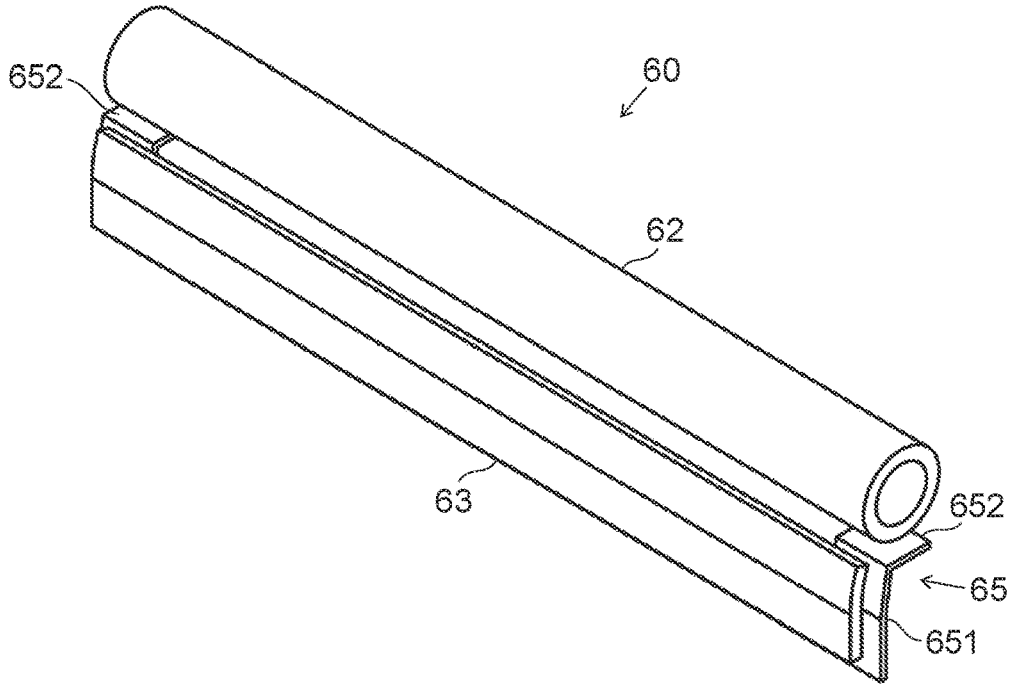
FIG. 5 is a perspective view of components inside the drum cleaning device in FIG. 4.
Figure 6:
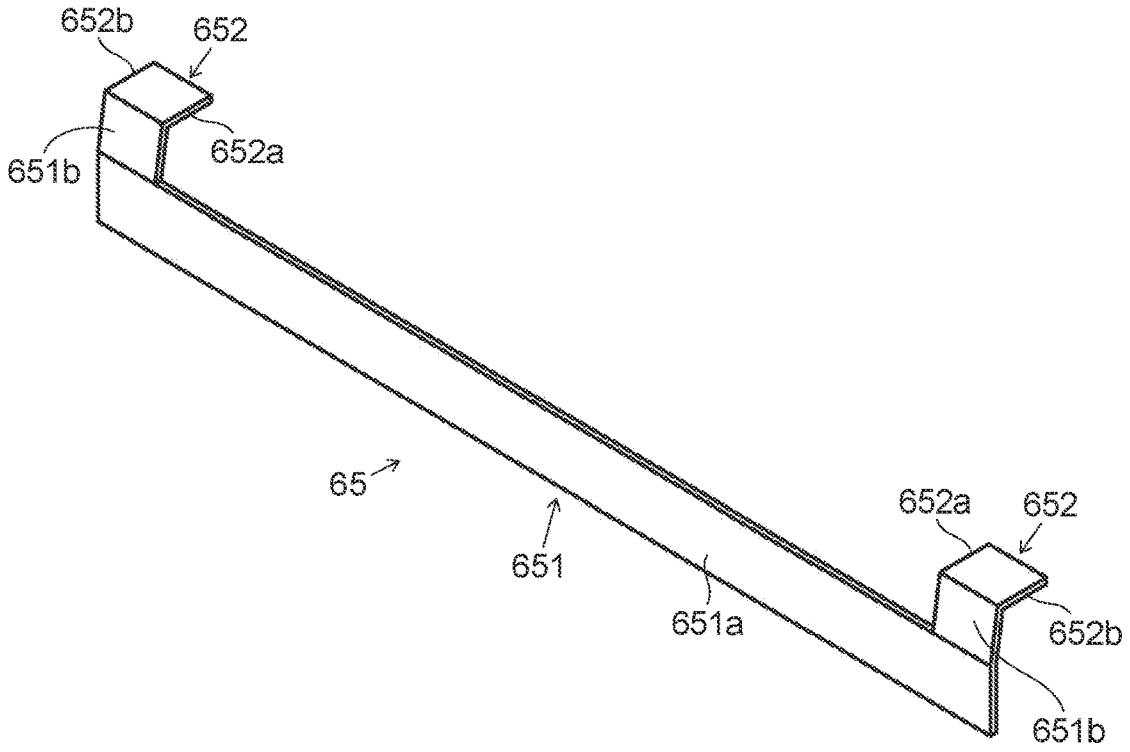
FIG. 6 is a perspective view of a toner keeping member in the drum cleaning device in FIG. 4.

FIG. 5 is a perspective view showing components inside the drum cleaning device 60 in FIG. 4. FIG. 6 is a perspective view of the toner keeping member 65 in the drum cleaning device 60 in FIG. 4. The toner keeping member 65 has a support portion 651 and two toner keeping portions 652.

The support portion 651 is disposed in a region away from the photosensitive drum 21 across the cleaning blade 63, and extends in the up-down direction. The support portion 651 has a fixed portion 651*a* and connecting portions 651*b*. The fixed portion 651*a* is disposed in a lower part of the support portion 651, and extends from one end side to the other end side of the polishing roller 62 in its axial direction. The fixed portion 651*a* is fixed to the collection container 61. The connecting portions 651*b* are provided at the opposite end sides of the polishing roller 62 along its axial direction. The two connecting portions 651*b* extend upward from an upper end part of the fixed portion 651*a*.

The two toner keeping portions 652 extend substantially horizontally from respective upper edge parts of the two connecting portions 651*b* of the support portion 651 in a direction away from the photosensitive drum 21. That is, the two toner keeping portions 652 are disposed at the opposite end sides of the polishing roller 62 along its axial direction. The toner keeping portions 652 are disposed under the polishing roller 62, with a gap left from the outer circumferential surface of the polishing roller 62. The toner keeping portions 652 extend in the axial direction of the polishing roller 62 and in the direction orthogonal to that axial direction, and are formed each in a rectangular shape as seen from the up-down direction. The toner keeping portions 652 stores between themselves and the polishing roller 62 the toner removed off the outer circumferential surface of the photosensitive drum 21.

Figure 7:
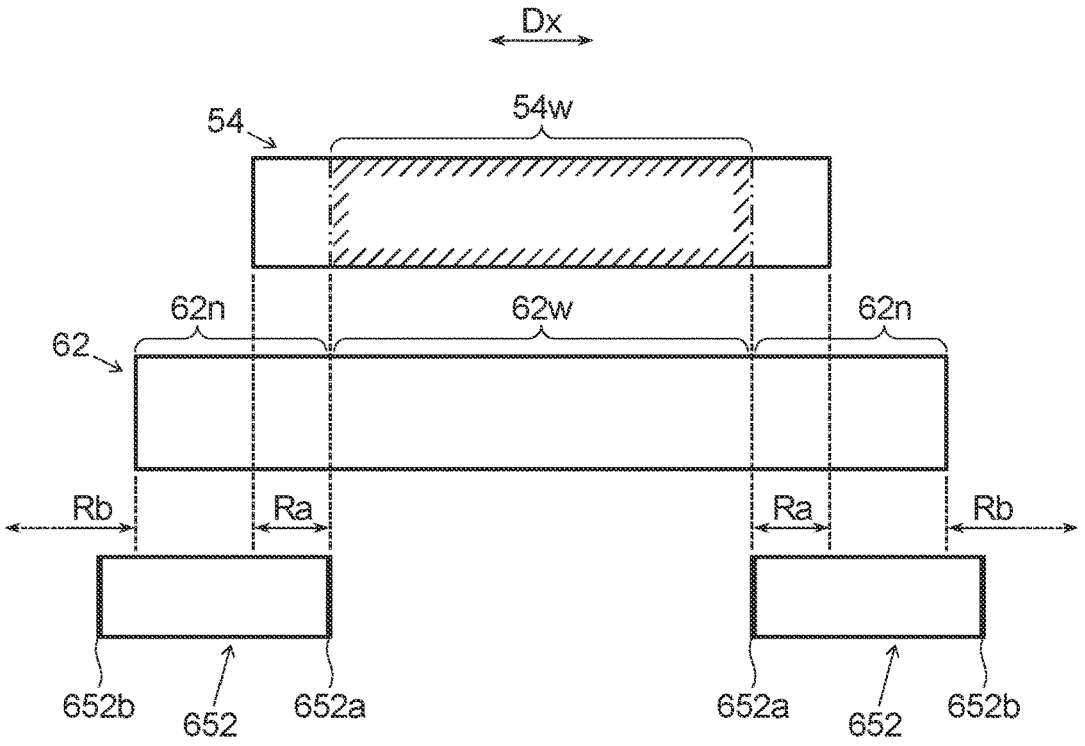
FIG. 7 is an illustrative diagram showing a positional relationship of a development roller, a polishing roller, and the toner keeping member in the image forming portion in FIG. 3.

FIG. 7 is an illustrative diagram showing a positional relationship of the developing roller 54, the polishing roller 62, and the toner keeping member 65 in the image forming portion 20 in FIG. 3. The arrowed line Dx in FIG. 7 indicates the axial direction of the developing roller 54 and the polishing roller 62.

As shown in FIG. 7, the developing roller 54 has a guaranteed development region 54*w*. The guaranteed development region 54*w* extends over a predetermined length from the middle to the opposite end sides of the developing roller 54 along its axial direction Dx. The length of the guaranteed development region 54*w* in the axial direction Dx is smaller than the length of the entire developing roller 54 in the axial direction Dx. The guaranteed development region 54*w* is a development region in which predetermined image quality is guaranteed. The developing device 50 can carry toner on the developing roller 54 even outside the guaranteed development region 54*w* along the axial direction Dx, but there image quality is not guaranteed.

As shown in FIG. 7, the length of the polishing roller 62 in the axial direction Dx is greater than the length of the developing roller 54 in the axial direction Dx. That is, opposite end parts of the polishing roller 62 in the axial direction Dx are located outward of opposite end parts of the developing roller 54 in the axial direction Dx.

As shown in FIG. 7, the toner keeping portions 652 extend along the axial direction Dx of the polishing roller 62. Respective one end parts 652*a* of the two toner keeping portions 652 along the axial direction Dx are located outward of end parts of the guaranteed development region 54*w* but inward of end parts of the developing roller 54, that is, inside a range Ra shown in FIG. 7. Respective other end parts 652*b* of the two toner keeping portions 652 along the axial direction Dx are located outward of end parts of the polishing roller 62, that is, in a region Rb shown in FIG. 7.

In the construction described above, toner can be attached to both of the following regions on the polishing roller 62: a region 62*w* corresponding to the guaranteed development region 54*w* and a region 62*n* corresponding to outside the guaranteed development region 54*w* along the axial direction Dx. The toner keeping portions 652 are not disposed near the region 62*w* on the polishing roller 62 corresponding to the guaranteed development region 54*w*, toner is prevented from piling up at where the photosensitive drum 21 and the cleaning blade 63 make contact with each other. It is thus possible to electrostatically charge the entire outer circumferential surface of the photosensitive drum 21 adequately, and to attach toner over the entire outer circumferential surface of the polishing roller 62.

Figure 8:
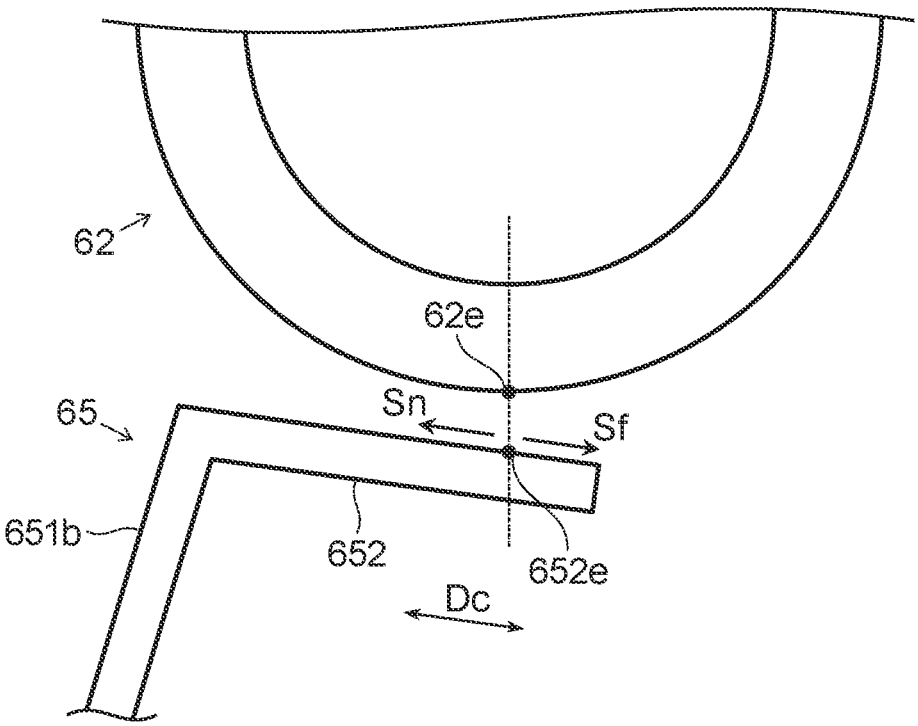
FIG. 8 is an enlarged part view of a toner keeping portion in the drum cleaning device in FIG. 4.

FIG. 8 is an enlarged part view of a toner keeping portion 652 in the drum cleaning device 60 in FIG. 4. As shown in FIG. 8, the toner keeping portion 652 extends in the direction Dc orthogonal to the axial direction of the polishing roller 62. With respect to the direction Dc orthogonal to the axial direction of the polishing roller 62, the toner keeping portion 652 extends from a position 652*e* facing a lower end part 62*e* of the polishing roller 62 in both of a direction Sn approaching the photosensitive drum 21 and a direction Sf receding from the photosensitive drum 21.

With the construction described above, it is possible to secure, with respect to the direction Dc orthogonal to the axial direction of the polishing roller 62, a satisfactorily large space for storage of toner. It is thus possible to attach toner adequately in the region 62*n* (see FIG. 7) on the polishing roller 62 corresponding to outside the guaranteed development region 54*w* along the axial direction.

The toner keeping member 65 has the two toner keeping portions 652 and the support portion 651 formed integrally (see FIG. 6). This structure allows easy positioning of the two toner keeping portions 652. It also helps reduce the number of components constituting the drum cleaning device 60.

The toner keeping member 65 is formed of metal. More specifically, the toner keeping member 65 is formed of a material with high thermal conductivity, such as aluminum. With this structure, the toner keeping member 65 contributes to enhanced heat dissipation. It is thus possible to suppress a rise in the temperature in the image forming portion 20.

As shown in FIG. 2, the image forming apparatus 1 includes a unit sensing portion 11 and a temperature/humidity sensing portion 12.

The unit sensing portion 11 includes, for example, an optical sensor or the like, and is disposed in the main body 2 such that its optical path is intercepted by the drum unit 22. The unit sensing portion 11 senses the mounting and removal of the drum unit 22 with respect to the main body 2. The control portion 8 can, by receiving the output signal of the unit sensing portion 11, recognize the replacement of the drum unit 22 as sensed by the unit sensing portion 11.

The temperature/humidity sensing portion 12 includes, for example, a temperature/humidity sensor of an electrical resistance type, a capacitance type, or the like, and is disposed near the casing of the main body 2. The temperature/humidity sensing portion 12 senses the temperature and humidity in the environment in which the image forming apparatus 1 is installed. The control portion 8 can, by receiving the output signal of the temperature/humidity sensing portion 12, recognize the temperature and humidity in the environment in which the image forming apparatus 1 is installed.

After the manufacture of the image forming apparatus 1, when it is shipped from the factory, settings are made on the image forming apparatus 1 so that it can recognize the timing of its being turned on for the first time after delivery to a user. Thus, after the image forming apparatus 1 is delivered to a user, it can recognize the timing of its being turned on for the first time.

The control portion 8 can execute a toner ejection mode in which toner is supplied from the developing device 50 to the outer circumferential surface of the photosensitive drum 21, is then removed by the cleaning blade 63, and is then stored in the toner keeping portion 652.

Figure 9:
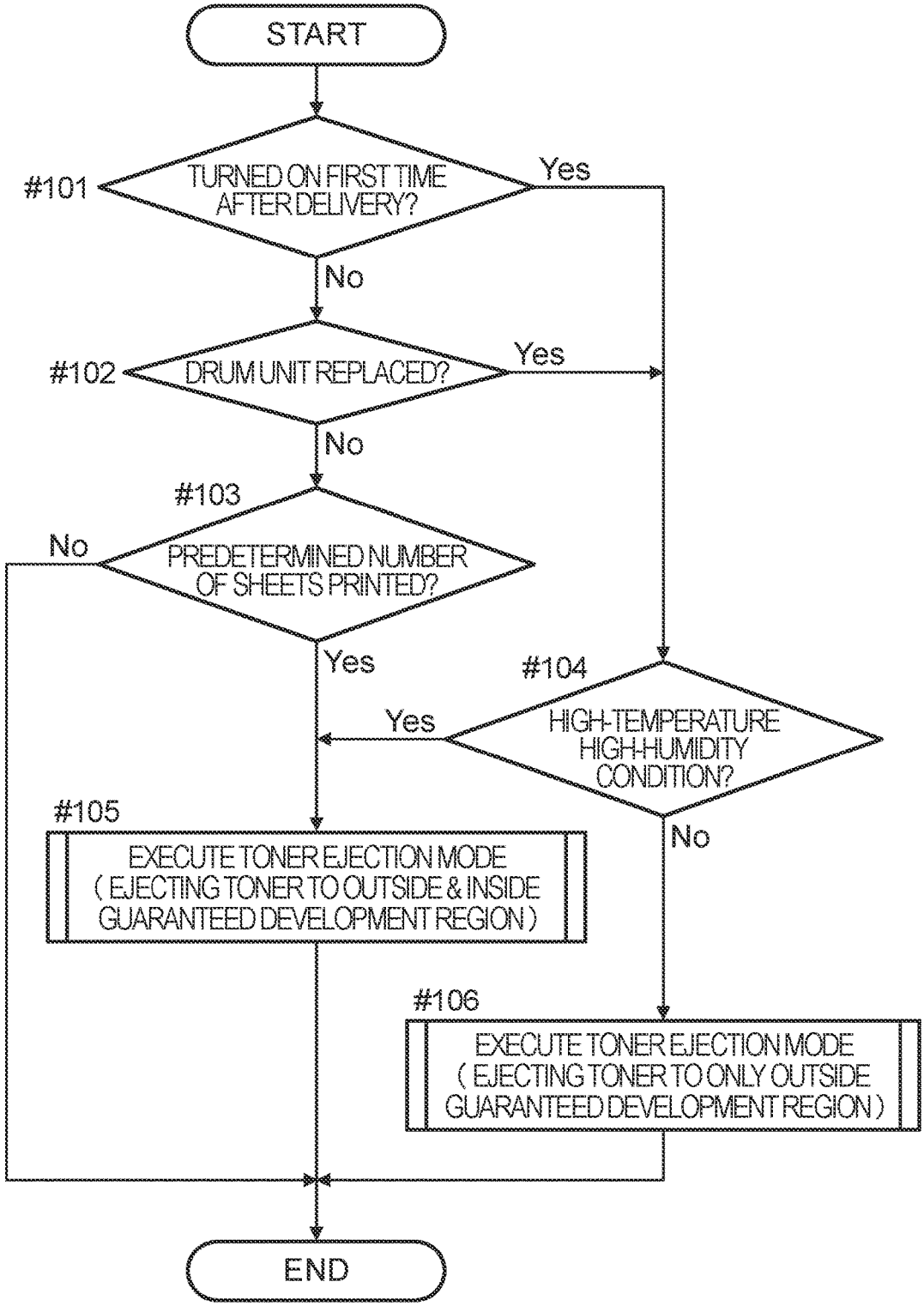
FIG. 9 is a flow chart showing one example of a procedure related to timing of execution of a toner ejection mode.

FIG. 9 is a flow chart showing one example of a procedure related to the timing of execution of the toner ejection mode. When the image forming apparatus 1 is started up ("START" in FIG. 9), the control portion 8 starts to check whether it is time to execute the toner ejection mode.

When the image forming apparatus 1 starts up, the control portion 8 checks whether or not this is the first time that it is turned on after its delivery to the user (step #101). After the manufacture of the image forming apparatus 1, when it is shipped from the factory, settings are made on the image forming apparatus 1 so that it can recognize the timing of its being turned on for the first time after delivery to a user.

If it is not the first time that the image forming apparatus 1 is turned on after its delivery to the user (step #101, "No"), the control portion 8 checks whether or not the drum unit 22 has been replaced (step #102). The control portion 8 can, by receiving the output signal from the unit sensing portion 11, sense replacement of the drum unit 22.

If the drum unit 22 has not been replaced (step #102, "No"), the control portion 8 checks whether or not the number of sheets S printed (having undergone image formation) has reached a predetermined number that is defined beforehand (step #103). More precisely, it checks whether or not after the toner ejection mode was executed the last time the number of sheets S printed has reached a predetermined number (e.g., 100 sheets). The predetermined number for the number of sheets S printed is stored in, for example, the storage portion or the like beforehand.

If it is the first time that the image forming apparatus 1 is turned on after its delivery to the user (step #101, "Yes"), and also if the drum unit 22 has been replaced (step #102, "Yes"), the control portion 8 check whether or not the temperature and humidity sensed by the temperature/humidity sensing portion 12 correspond to a predetermined high-temperature high-humidity condition (step #104).

If after the toner ejection mode was executed the last time the number of sheets S printed (having undergone image formation) has reached the predetermined number (step #103, "Yes"), and also if the environment in which the image forming apparatus 1 is installed is a high-temperature high-humidity condition (step #104, "Yes"), the control portion 8 executes the toner ejection mode so that the developing device 50 ejects toner to both outside and inside the guaranteed development region 54*w* (see FIG. 7) on the developing roller 54 (step #105).

If the environment in which the image forming apparatus 1 is installed is not a high-temperature high-humidity condition (step #104, "No"), the control portion 8 executes the toner ejection mode so that the developing device 50 ejects toner to only outside the guaranteed development region 54*w* (see FIG. 7) on the developing roller 54 (step #106).

As described above, the control portion 8 can perform the toner ejection mode when the image forming apparatus 1 is turned on for the first time after its delivery to a user and when the drum unit 22 is replaced. With this configuration, it is possible, when a new drum cleaning device 60 starts to be used, to store toner on the toner keeping portion 652. Thus, as soon as the new drum cleaning device 60 starts to be used, it is possible to electrostatically charge the entire outer circumferential surface of the photosensitive drum 21 adequately, and to attach toner over the entire area of the outer circumferential surface of the polishing roller 62.

In the toner ejection mode, based on the temperature and humidity in the installation environment of the image forming apparatus 1 as sensed by the temperature/humidity sensing portion 12, the control portion 8 makes the developing device 50 eject toner to at least outside the guaranteed development region 54*w* on the developing roller 54. With this configuration, based on the temperature and humidity in the installation environment of the image forming apparatus 1, in the toner ejection mode, toner can be ejected to also inside the guaranteed development region 54*w* on the developing roller 54.

In the toner ejection mode, when the temperature and humidity in the installation environment of the image forming apparatus 1 as sensed by the temperature/humidity sensing portion 12 correspond to a predetermined high-temperature high-humidity condition, the control portion 8 makes the developing device 50 eject toner to both outside and inside the guaranteed development region 54*w* on the developing roller 54. In the toner ejection mode, when the temperature and humidity in the installation environment of the image forming apparatus 1 as sensed by the temperature/humidity sensing portion 12 does not correspond to a high-temperature high-humidity condition, the control portion 8 makes the developing device 50 eject toner to only outside the guaranteed development region 54*w* on the developing roller 54.

With the configuration described above, in particular under a high-temperature high-humidity condition, which is prone to cause image deletion, it is possible to attach toner over the entire area of the outer circumferential surface of the polishing roller 62. That is, it is possible to suppress image deletion. Unless under a high-temperature high-humidity condition, image deletion is unlikely, and toner only needs to be attached in the region 62*n* (see FIG. 7) on the polishing roller 62 corresponding to outside the guaranteed development region 54*w* in the axial direction. It is thus possible to reduce the amount of toner consumed in the toner ejection mode.

The amount of toner ejected to outside the guaranteed development region 54*w* on the developing roller 54 is larger than the amount of toner ejected to inside the guaranteed development region 54*w*. That is, the amount of toner ejected to inside the guaranteed development region 54*w* is smaller than amount of toner ejected to outside the guaranteed development region 54*w*. With this configuration, it is possible to reduce the amount of toner consumed in the toner ejection mode.

Every time a predetermined number of sheets S are printed (undergo image formation), the control portion 8 executes the toner ejection mode. With this configuration, it is possible to execute the toner ejection mode on a regular basis during the normal operation of the image forming apparatus 1.

While an embodiment of the present disclosure has been described it is in no way meant to limit the scope of the present disclosure, which can thus be implemented with any modifications made without departure from the spirit of the present disclosure.

For example, while the embodiment described above deals with an example where the image forming apparatus 1 is what is called a tandem-type color-printing image forming apparatus that forms images of a plurality of colors sequentially while overlaying one on another, this is not meant as any limitation to models of a particular type; the image forming apparatus may instead be a color-printing image forming apparatus of other than a tandem type, or a monochrome-printing image forming apparatus.

What is claimed is:

1. An image forming apparatus, comprising:

an image carrying member which has a photosensitive layer on an outer circumferential surface thereof;

a charging device which electrostatically charges the outer circumferential surface of the image carrying member;

an exposing device which exposes to light the outer circumferential surface of the image carrying member electrostatically charged by the charging device to form an electrostatic latent image on the outer circumferential surface of the image carrying member;

a developing device having:

a developing roller which extends parallel to an axial direction of the image carrying member and which is disposed close to the image carrying member, the developing roller attaching toner to the electrostatic latent image to form a toner image;

a cleaning device having:

a cleaning blade which extends along the axial direction of the image carrying member and which makes contact with the outer circumferential surface of the image carrying member to remove toner on the outer circumferential surface of the image carrying member; and a polishing roller which extends parallel to the axial direction of the image carrying member and which rotates while in contact with the outer circumferential surface of the image carrying member to polish the outer circumferential surface of the image carrying member, wherein the developing roller has a guaranteed development region that extends over a predetermined length from a middle toward opposite end sides along the axial direction, opposite end parts of the polishing roller along the axial direction are located outward of opposite end parts of the developing roller, the cleaning device has a toner keeping member, the toner keeping member having toner keeping portions that are disposed at opposite end sides of the polishing roller along the axial direction with a gap left from an outer circumferential surface of the polishing roller, the toner keeping portions keeping between themselves and the polishing roller the toner removed off the outer circumferential surface of the image carrying member, the toner keeping portions extend along an axial direction of the polishing roller, and of each of the toner keeping portions, one end part along the axial direction is located outward of an end part of the guaranteed development region but inward of an end part of the developing roller and another end part is located outward of the end part of the polishing roller.

2. The image forming apparatus according to claim 1, wherein the toner keeping portions extend, with respect to a direction orthogonal to the axial direction of the polishing roller, in both directions approaching and receding from the image carrying member across a position facing a lower end part of the polishing roller.

3. The image forming apparatus according to claim 1, wherein the toner keeping member has a support portion which connects together and supports the two toner keeping portions disposed at the opposite end sides of the polishing roller along the axial direction, and the two toner keeping portions and the support portion are formed integrally.

4. The image forming apparatus according to claim 1, wherein the toner keeping member is formed of metal.

5. The image forming apparatus according to claim 1, further comprising:

a unit which includes at least the image carrying member and the cleaning device and which is removably mounted in a main body of the image forming apparatus;

a unit sensing portion which senses mounting and removal of the unit; and a control portion which controls operation of the image carrying member, the charging device, the exposing device, the developing device, and the cleaning device, wherein the control portion can recognize replacement of the unit as sensed by the unit sensing portion and timing of the image forming apparatus being turned on for a first time after delivery to a user, and the control portion can execute a toner ejection mode in which, when the image forming apparatus is turned on for the first time and when the unit is replaced, toner is supplied from the developing device to the outer circumferential surface of the image carrying member, is then removed by the cleaning blade, and is then kept in the toner keeping portions.

6. The image forming apparatus according to claim 5, further comprising:

a temperature/humidity sensing portion which senses temperature and humidity in an environment in which the image forming apparatus is installed, wherein in the toner ejection mode, based on the temperature and the humidity sensed by the temperature/humidity sensing portion, the control portion makes the developing device eject toner to at least outside the guaranteed development region on the developing roller.

7. The image forming apparatus according to claim 6, wherein in the toner ejection mode, if the temperature and the humidity sensed by the temperature/humidity sensing portion correspond to a predetermined high-temperature high-humidity condition, the control portion makes the developing device eject toner to both outside and inside the guaranteed development region on the developing roller, whereas otherwise the control portion makes the developing device eject toner to only outside the guaranteed development region on the developing roller.

8. The image forming apparatus according to claim 6, wherein an amount of toner ejected to outside the guaranteed development region on the developing roller is greater than an amount of toner ejected to inside the guaranteed development region.

9. The image forming apparatus according to claim 5, wherein the control portion executes the toner ejection mode every time image formation has been performed on a predetermined number of sheets of a recording medium.

* * * * *